United States Patent [19]

Leach

[11] 3,934,710

[45] Jan. 27, 1976

[54] MATERIAL HANDLING CONVEYOR

[76] Inventor: John Meredith Leach, P.O. Box 341, Port Jefferson, N.Y. 11777

[22] Filed: June 26, 1974

[21] Appl. No.: 483,250

[52] U.S. Cl. ..... 198/143; 198/152; 220/331

[51] Int. Cl.[2] ..... B65G 17/16; B65D 45/06

[58] Field of Search ..... 198/140, 141, 143, 152, 198/177; 220/331, 332, 333, 330, 329; 105/286, 296, 304; 222/450

[56] References Cited

UNITED STATES PATENTS

| | | | |
|---|---|---|---|
| 1,144,159 | 6/1915 | Truxall | 220/331 X |
| 1,328,672 | 1/1920 | Hirsohn | 220/330 |
| 2,338,258 | 1/1944 | Ray | 198/143 |
| 2,529,478 | 11/1950 | Bach | 220/333 X |
| 2,595,689 | 5/1952 | Mitchell | 198/143 |
| 2,736,455 | 2/1956 | Rosen | 220/333 X |
| 3,067,986 | 12/1962 | Grantham | 220/331 X |
| 3,266,621 | 8/1966 | Leach | 198/177 |
| 3,342,307 | 9/1967 | Leach | 198/152 X |
| 3,384,385 | 5/1968 | Cohen | 220/333 X |
| 3,814,234 | 6/1974 | Santen | 198/143 |

*Primary Examiner*—Evon C. Blunk
*Assistant Examiner*—James L. Rowland

[57] ABSTRACT

A material handling conveyor comprising an overhead conveyor which supports containers or magazines for the material. The magazines have top and bottom openings and a closure for each which includes a closure mechanism having a movable lever. The first part of the movement of said lever effects the closing of the magazine and the last part of the movement of said lever clamps the closure down tight on the magazine to provide a leakproof seal. The entire area of the magazine which is in contact with the material being carried is made of an inert substance such as stainless steel or a plastic which is supported by a frame made of a stronger substance which also carries the full weight of the magazine and the material being in the magazine, thereby relieving the inert substance part of the magazine from carrying the load which enables that part to be made of lighter construction.

11 Claims, 7 Drawing Figures

MATERIAL HANDLING CONVEYOR

BACKGROUND OF THE INVENTION

This invention relates to bulk material handling conveyors of the type wherein closed containers or magazines which hold the material being conveyed and which magazines are themselves conveyed by a flexible multi-plane and direction conveyor such, for example, as an overhead conveyor. This type of invention is best exemplified by U.S. Pat. No. 3,266,621 on which the present invention is an improvement. All of the objects and advantages of the invention stated in that patent apply with equal force and accuracy to the present invention.

SUMMARY OF THE INVENTION

It has been found that some bulk materials are in such finely divided state that the magazine closures must be tightly sealed under considerable pressure in order to avoid all spillage. It is an object of this invention to provide such a tight closure. It is also an object of the present invention to provide an inexpensive magazine in which all areas in contact with the material being conveyed is formed of a substance which is entirely unaffectby the material.

It is a further object of the present invention to provide an inexpensive magazine in which all areas of the magazine in contact with the material being conveyed is formed of a substance which does not in any way affect the material. It is another object of the invention to provide an inexpensive magazine in which the material of the magazine which is in contact with the material being carried does not carry the weight of the magazine and material being carried which thereby enables such magazine material to be of lighter and cheaper construction.

Other objects and advantages of the present invention will become apparent to those skilled in the art upon recourse to the following specification and claims.

BRIEF DESCRIPTION OF THE DRAWINGS

The now preferred embodiment of the present invention is disclosed in the accompanying drawings which are to be considered as descriptive and not limitative as many changes and modifications can be made in the structural details without departing from the spirit of the Invention.

In the drawings.

DETAILED DESCRIPTION

The magazine of the present invention comprises a hanger fork 10 provided with hanger plates 12 and 14 for attachment of the magazine to any desired type of overhead conveyor in the manner shown by U.S. Pat. No. 3,266,621.

Figure 3:
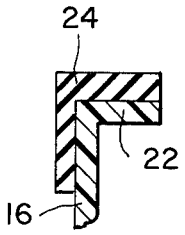
FIG. 3 is a fragmentary cross sectional view taken on the plane indicated by line 3 —3 of FIG. 1 and looking in the direction of the arrows.

A magazine shell 16 is suitably attached to the hanger fork 10 as by bolts and nuts 18. The shell 16 is formed of any desired material such, for example, as carbon steel, stainless steel, copper, aluminum or a plastic. Numerous plastics may be used such as nylon; polyproplyene or polyethylene. A preferred plastic at the present time is polyethylene because of its strength, price, cleanability, moldability and because it is inert to most chemicals and food stuffs and is approved by regulatory agencies. When a plastic is used for shell 16 the inner heads of the bolts 18 can be buried in the walls so that they do not come in contact with any material. The plastic is also light and can be flared outwardly at the top and bottom as shown at 20 and provided with inwardly extending flanges 22 (see FIG. 3) stiffen the shell and form a seat for a suitable gasket 24 molded from rubber or neoprene or the like to fit tightly over the top and bottom rims of the shell 16. This type of gasket can be removed for cleaning and replaced very quickly where regulatory agency rules require such maintainance.

Figure 4:
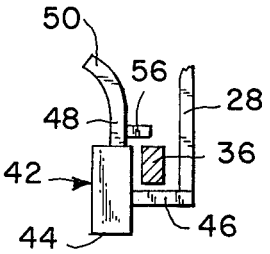
FIG. 4 is a fragmentary cross sectional view on the plane indicated by the line 4 — 4 of FIG. 1 and looking in the direction of the arrows.
Figure 5:
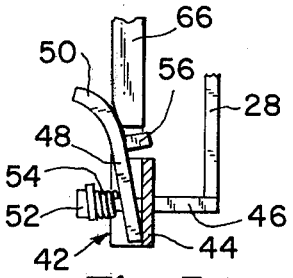
FIG. 5 is a fragmentary cross sectional view on the plane indicated by line 5 — 5 of FIG. 1 and looking in the direction of the arrows.

The closures for the top and bottom of the shell 16 are identical so that only one will be described in detail. The top closure 26 is shown in open position and the bottom closure 26 is shown in closed position in FIGS. 1 and 2. Each closure 26 consists of two end plates 28 interconnected by a panel 30 also preferably formed of polyethylene. Each plate 28 is provided with a flange 32 on which a panel 30 is supported and fastened to the flange 32 in a suitable manner as by rivets (not shown) positioned outside of the area contacted by the material being conveyed so that the material comes into contact with nothing but the plastic which does not in any way contaminate the material, nor does the material in any way affect the rivets. Each of the end plates 28 is provided with an elongated opening 34 which fits over a bolt 18 and thus forms a pivot point around which a closure rotates from open to closed position and vice versa, see FIG. 6. A closure liner actuator fork 36 is pivoted on each pair of opposite bolts 18 and is operated by a cam follower 38 in the same manner as shown in FIG. 5 of said U.S. Pat. No. 3,266,621 or if desired can be operated by an air cylinder or even a hand lever when the overhead conveyor is intermittently driven. The bend 40 is placed in the fork 36 for a reason to be described later and a second bend can be placed in the fork 36 nearer the cam follower 38 if such is required for any reason, such as to avoid obstacles. Each closure actuator fork 36 is connected to its respective closure 26 by means of a latch 42 (see particularly FIGS. 4 and 5). Each latch 42 comprises a channel 44 connected to an end plate 28 by a web 46. One side of the channel 44 is removed in FIG. 5 to reveal the inner mechanism of the latch which comprises a latch lever 48 which is turned up at one end as shown at 50. A screw 52 is passed through an enlarged hole (not shown) in the latch lever and seated in the bottom plate of the channel 44 which permits the latch lever to move in the channel from the position shown in FIG. 4 to the position shown in FIG. 5 while guided by the sides of the channel. A coil spring 54 surrounds the screw between its head and the latch lever and normally retains the latch lever in the position shown in FIG. 4. A retainer lug 56 is suitably fastened to the latch lever 48. This retainer lug 56 captures the closure actuator fork 36 in the position shown in FIGS. 1 and 4 and effectively connects the closure actuator 36 and the closure 26 for movement together. When the closure actuator fork 36 is suitably moved (as explained above) in a clockwise direction as shown in FIG. 1 the top closure 26 will move with it about its bolt pivot 18 until the top closure 26 completely covers the opening in the top of the magazine shell and assumes the position shown by the bottom closure shown in FIG. 1. At this point the end plates 28 of the top closure strike the stops 58 carried by the tines of the hanger fork 10 (stops 58, 60, 62 and 64 are not shown in FIG. 2 to avoid obscuring other components) and the top closure 26 stops farther movement and remains in closed position. This stoppage was possible because the retainer lugs 56 were moved out of contact with the closure actuator fork 36 just as the closure end plates contacted the stops 58, and the actuator fork 36 continued movement until it contacted the top bar of the hanger fork 10 and assumed a position corresponding to the position of the bottom actuator fork 36 shown in FIG. 1. This movement of the retainer lugs 56 was caused by movement of the latch levers 48 to which the lugs are attached due to the turned up ends 50 of the latch levers striking cams 66 carried by the hanger fork 10, as shown in FIG. 5.

It will thus be seen that the first part of the continuous movement of the closure actuator 36 produced a complete closing of the top closure 26. The second part of the continuous movement of the top closure actuator caused the top closure to be clamped tightly down upon the top gasket 24 to produce air, dust and water tight sealing of the top closure. This clamping action was effected as follows: refer to FIG. 6 wherein three elements are shown, a closure end plate 28, a closure actuating fork 36 and a pressure link 68 having a stud 70 on one side of one end which has a bearing fit in a hole formed in the end plate and a stud 72 on the opposite side of the other end which has a bearing fit in a hole in the closure actuating fork 36. The actuating fork is actually pivoted on the bolt 18 in FIG. 6 assembly but has been cut away in order to show the elongated opening 34 for bolt 18 in end plate 28. As the closure actuating fork continued moving after being released by the latch stud 56 which enabled the closure to stop when it contacted stops 58, it was then moving relative to end plates 28 instead of with them. This relative movement caused pressure link 68 to rotate in the direction of the arrow about stud 70 and the stud 72 to rotate in the hole in actuator fork 36 which permitted the actuator fork to gradually overlie the link 68 as the two assumed a vertical position. This caused the link 68 to press the end plates 28 downwardly as the stud 70 approached bolt 18 and move the end plates downwardly to compress the gasket 24 which end plate movement was possible because of the elongated opening 34 for the bolt 18. The amount of pressure exerted against the gasket 24 by the closure 26 can be increased by shortening the pressure link 68 and maintaining the center of stud 70 on the center line shown in FIG. 6. This makes practically any desired sealing pressure possible.

Figure 6:
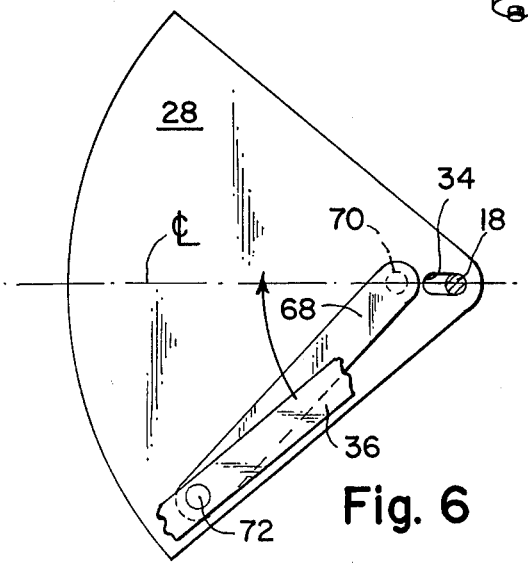
FIG. 6 is a view of three of the components of the magazine closing and locking mechanism.
Figure 7:
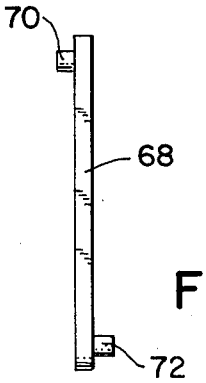
FIG. 7 is a side view of one of the components shown in FIG. 6.

The bend 40 in the closure actuating fork 36 makes it possible for the fork to move slightly over the center line shown in FIG. 6 before it contacts the hanger fork 10 and stops. The reaction force of the gasket then acting along the pressure link 68 creates a toggle effect which releasably locks the actuation fork 36 in the over center position and prevents accidental release of the closure pressure. The actual position of the closure actuation fork when locked is better shown on the bottom closure 26 in FIG. 1.

The opening action of the top closure 26 is just the reverse of the closing action. That is, the initial moving force against the cam follower 38 in a counterclockwise direction as viewed in FIG. 1 unlocks the top closure actuating fork and then moves it along to reduce the pressure on the gasket 24 and gradually raise the top closure 26 until it is just touching the gasket 24 and then the fork 36 picks up the web 46 of the latch 42 and moves it and the end plates 28 which releases the latch lever 48 and permits the retainer lug 56 to move in behind the actuating fork 36 which continues until the end plates 28 contact the stops 62 and stop in the position shown in FIG. 1.

Figure 1:
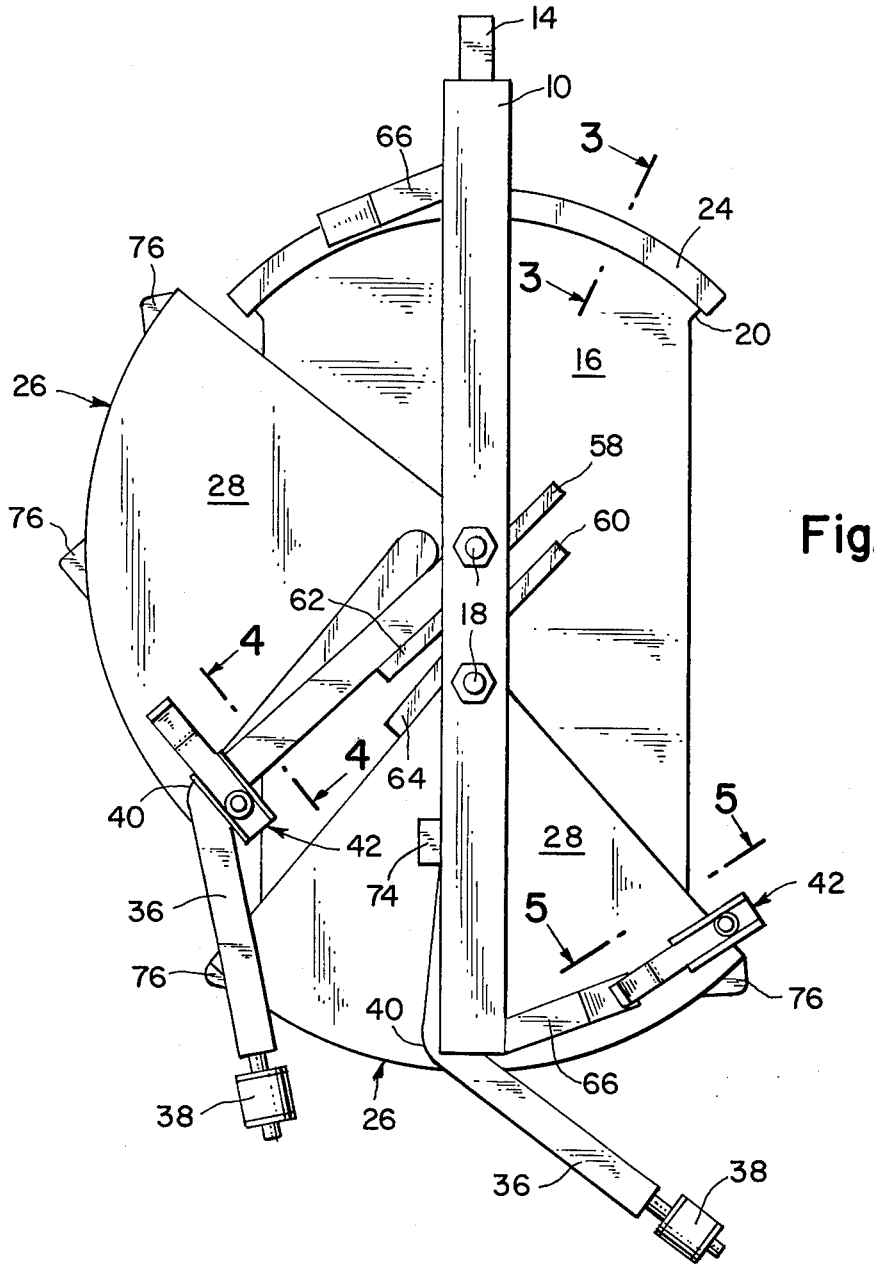
FIG. 1 is an end view of a conveyor material container or magazine constructed in accordance with the present invention.
Figure 2:
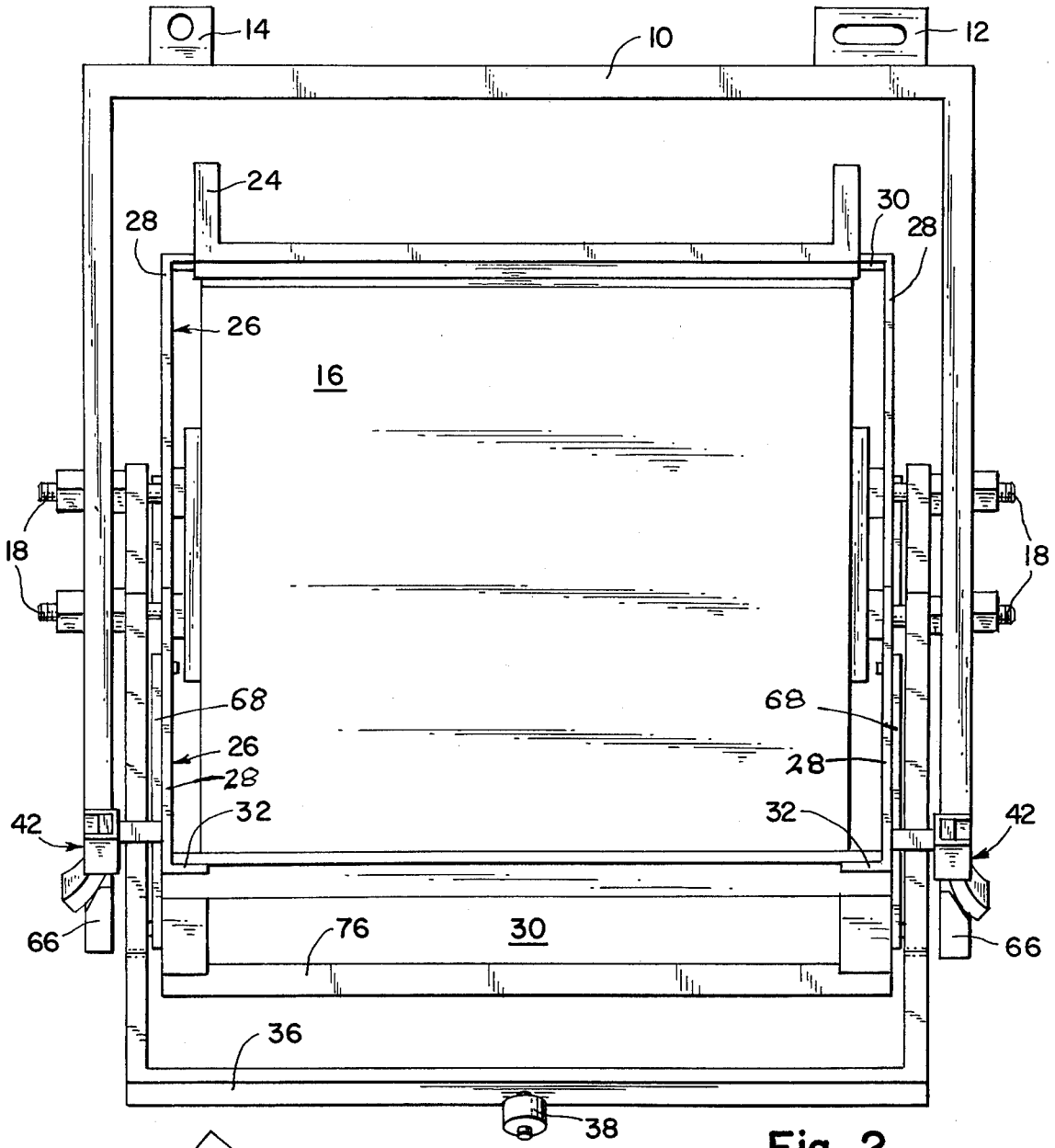
FIG. 2 is a side view of the magazine shown in FIG. 1.

The pressure control action of the pressure link 68 is adjusted as above explained so that the panels 30 lightly brush the gaskets 24 during closing movements so as to wipe them clean of any foreign matter or dust and thus prevent any build up upon the gaskets. The opening and closing action of the bottom closure shown in FIG. 1 is exactly the same as that of the top closure explained above from the time it leaves the stops 64 until it contacts the stops 60 and then returns on the closing action. The only structural difference between the top and bottom closures is a stop 74 attached to the hanger fork 10 for the bottom actuator fork 36 which is needed because the hanger fork has no bar at the bottom. Reinforcing bars 76 are connected to and extend between the flanges 36 to stiffen the closures 26 and add support to the panels 30. The magazine shells 16 are preferably given slight inside draft downwardly to expedite dropping of the material from the magazines very quickly.

It will be noted that the entire weight of the magazine and its contents will be carried by the load hanger 10, the bolts 18, the bottom closure actuator 36, the pressure link(bottom) 68, the bottom sideplates 28 and the reinforcing bars 76. Thus the plastic shell 16 and the plastic closure panels are entirely relieved of carrying any tensile load which makes it possible to make these elements much thinner and lighter than if they were load carrying elements. The elements 10,18,36,68 28 and 76 form a metallic frame. It will be noted that the closures 26, particularly the top closure 26, can be made as much smaller than the entire horizontal shell 16 section as desired in order to decrease the area of the opening.

A fork 36 serves as a closure actuating lever for both the top and bottom closures.

It can thus be seen that the material handling system of the present invention includes a material containing magazine in which all areas in contact with the material can not in any way affect the material or be affected by the material, in which the closures for the magazine can be tightly clamped in sealing condition so that absolutely no leakage can occur, and in which the full load weight of the magazine and its contents is carried by a frame separate from the elements which form the material contacting areas.

The invention having been described, what is claimed is:

1. A material handling system comprising a supporting conveyor, a material holding magazine including a shell for restraining the material laterally being conveyed and having a bottom opening, a closure for said opening for restraining said material vertically and movable from an open to a closed position in which it is in contact with said shell, a movable lever, means interconnecting said closure and lever which causes the movement of said lever to first move said closure across said shell and stop in closing position adjacent said opening and then upon further movement of said lever clamp said closure towards said shell into closed sealing position over said opening and in contact with said shell, and a supporting frame for said shell including said movable lever and extending from said conveyor down under said magazine and in contact with said closed closure so as to carry the full load of said magazine and its contents when said closure is closed and thus relieve said shell of the weight load of said magazine and its contents.

2. A material handling system comprising a supporting conveyor, a material holding magazine, means supporting said magazine on said conveyor, said magazine including a shell having an opening therein surrounded by walls which have arcuate extremeties on two sides, a movable closure for said shell opening which is curved to fit said arcuate extremeties of said walls, a movable lever pivotally mounted directly on said shell for arcuate movement only, and means interconnecting said closure and lever which causes arcuate movement of said lever to first move said closure across and in close proximity to said arcuate extremeties of said shell and adjacent to said opening and stop and then upon further arcuate movement of said lever clamp said closure in a straight path towards and into contact with said arcuate extremeties of said shell in closed, sealing position.

3. A material handling system as specified in claim 2 in which said means includes a link pivoted near one end to said lever and pivoted near the other end to said closure.

4. A material handling system as specified in claim 2 in which said closure includes an end plate pivoted to said shell with an elongated pivot opening in said end plate at the pivot point, a closure panel carried by said end plate, and said means includes a link pivoted near one end to said lever and pivoted near the other end to said end plate.

5. A material handling system as specified in claim 4 in which said lever is pivoted on the same center as said end plate is pivoted to said shell and the pivot point of said link to said end plate is at a distance in the direction of said closure panel from the pivot point of said lever and end plate to said shell, whereby the closure panel is clamped against said shell over said opening in closed sealing position as said lever and said link become superposed.

6. A material handling system as specified in claim 5 in which said means also includes a releasable connection between said lever and said end plate and a cam for releasing said releasable connection when said closure reaches closing position adjacent to said opening to free said lever for further movement to clamp said closure panel in closed sealing position over said opening.

7. A material handling system as specified in claim 5 in which a stop is provided to discontinue all movement of said lever slightly after said lever and said link become superposed whereby the clamping pressure holds the lever in the over center position thus created.

8. A material handling system comprising a supporting conveyor, a material holding magazine including a shell having a bottom opening, a movable closure for said opening, means for moving said closure from an open to a closed position, and a supporting frame for said magazine connected to and extending from said conveyor down under said magazine and in contact with said closure when in closed position so as to carry the full load of said magazine and its contents when said closure is in closed position and thus relieve said shell of of the weight load of said magazine and its contents.

9. A material handling system as specified in claim 8 wherein said shell and that part of said closure which closes the opening in said shell is formed of a plastic, and said supporting frame is formed of metal with no metal part extending in to the interior of said shell even when closed by said closure whereby the material being conveyed never comes into contact with any metal.

10. A material holding magazine comprising a shell having an opening therein surrounded by walls which have arcuate extremeties on two opposite sides, a movable closure for said shell opening which is curved to fit the arcuate extremeties of said walls, a movable lever pivotally mounted directly on said shell for arcuate movement only, and means interconnecting said closure and lever which causes said arcuate movement of said lever to first move said closure across and in close proximity to said arcuate extremeties of said shell and adjacent to said opening into closing position and stop and then upon further arcuate movement of said lever clamp said closure in a straight path towards and into contact with said arcuate extremeties of said shell in closed, sealing position over said opening.

11. A material holding magazine comprising a shell for holding the material and having an opening therein, a closure for said opening comprising a panel for covering said opening and a side plate attached to said panel and pivoted loosely to said shell to enable said closure to rotate from open to closed position and vice versa, a movable lever pivotably connected to said shell, a releasable clamp carried by said side plate in position to clamp said lever to said side plate when said closure is in open position so as to move said closure upon movement of said lever, a linkage connected between said lever and said side plate and not movable other than with said lever and side plate when clamped together, and a release for said clamp in position to release said clamp when said closure reaches closed position so as to enable said lever to move relative to said closure and through said linkage to clamp said closure tightly against said shell over said opening.

* * * * *

UNITED STATES PATENT OFFICE

CERTIFICATE OF CORRECTION

Patent No. 3,934,710 Dated January 27, 1976

Inventor(s) John Meredith Leach

It is certified that error appears in the above-identified patent and that said Letters Patent are hereby corrected as shown below:

Column 2, line 46, "liner" should read -- lever --.

Signed and Sealed this

*thirteenth* Day of *April 1976*

[SEAL]

*Attest:*

RUTH C. MASON
*Attesting Officer*

C. MARSHALL DANN
*Commissioner of Patents and Trademarks*